US006113010A

United States Patent [19]

Wu-Hsiung

[11] Patent Number: 6,113,010

[45] Date of Patent: Sep. 5, 2000

[54] TOILET BOWL CLEANING DEVICE

[76] Inventor: Hsieh Wu-Hsiung, No. 241, Ai Kuo Street, 22 Lin, Chung Yang Li, Feng Yuan City, Taichung Hsien, Taiwan

[21] Appl. No.: 09/312,870

[22] Filed: May 17, 1999

[51] Int. Cl.[7] ..... B05B 9/08

[52] U.S. Cl. ..... 239/530; 239/525; 239/390; 239/397; 239/548

[58] Field of Search ..... 239/390, 397, 239/525, 530, 548, 552, 567

[56] References Cited

U.S. PATENT DOCUMENTS

| | | | |
|---|---|---|---|
| 4,674,687 | 6/1987 | Smith et al. | 239/525 X |
| 5,090,624 | 2/1992 | Rogers | 239/525 X |
| 5,765,760 | 6/1998 | Kuo | 239/552 X |

*Primary Examiner*—Andres Kashnikow
*Assistant Examiner*—Robin O. Evans
*Attorney, Agent, or Firm*—Harrison & Egbert

[57] ABSTRACT

A cleaning device of a toilet bowl having a handle tube, which is provided at one end with a head seat. The head seat is formed with a receiving area at one side and covered by a retainer. The retainer is provided with a receiving hole for receiving a perforated plate. A bolt passes through the center of the perforated plate to insert into the pillar of head seat, and a rod inserts into the socket of the of head seat from the rear of the perforated plate. The surface of the perforated plate is formed with a circular trough, which is provided with a plurality of pins engaging inside with a ring body. The surface of ring body is formed with a plurality of protuberances.

3 Claims, 8 Drawing Sheets

TOILET BOWL CLEANING DEVICE

FIELD OF THE INVENTION

The present invention relates generally to a flushing of toilet, and more particularly to an improved cleaning device of a toilet bowel.

BACKGROUND OF THE INVENTION

As illustrated in FIGS. 1 and 2, the conventional cleaning of a device toilet is provided with a handle tube 10 having a head seat 11 expanded at one end thereof. The head seat 11 is hollow inside, connecting with the handle tube 10 and further provided with a pillar 12 at the center. The opening 13 of head seat 11 is covered by a shelter 14, which is provided with a plurality of holes 15 on the surface and the shelter 14 is passed through by a bolt 16 to connect with the pillar 12 of head seat 11.

However, such a prior art is defective in design because the shelter 14 is easy loosened and can come off, resulting in that the user must often tighten up said shelter 14. As a result, the connection of the shelter 14 with the thread 17 of head seat 11 or the connection of the bolt 16 with the pillar 12 will loosen and further start a leak.

SUMMARY OF THE INVENTION

The primary objective of the present invention is therefore to provide an improved cleaning device of a toilet with a special device in the head seat, the retainer, the perforated plate, and the ring body. Such device is free from the drawback of the prior art described above.

The objectives, features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
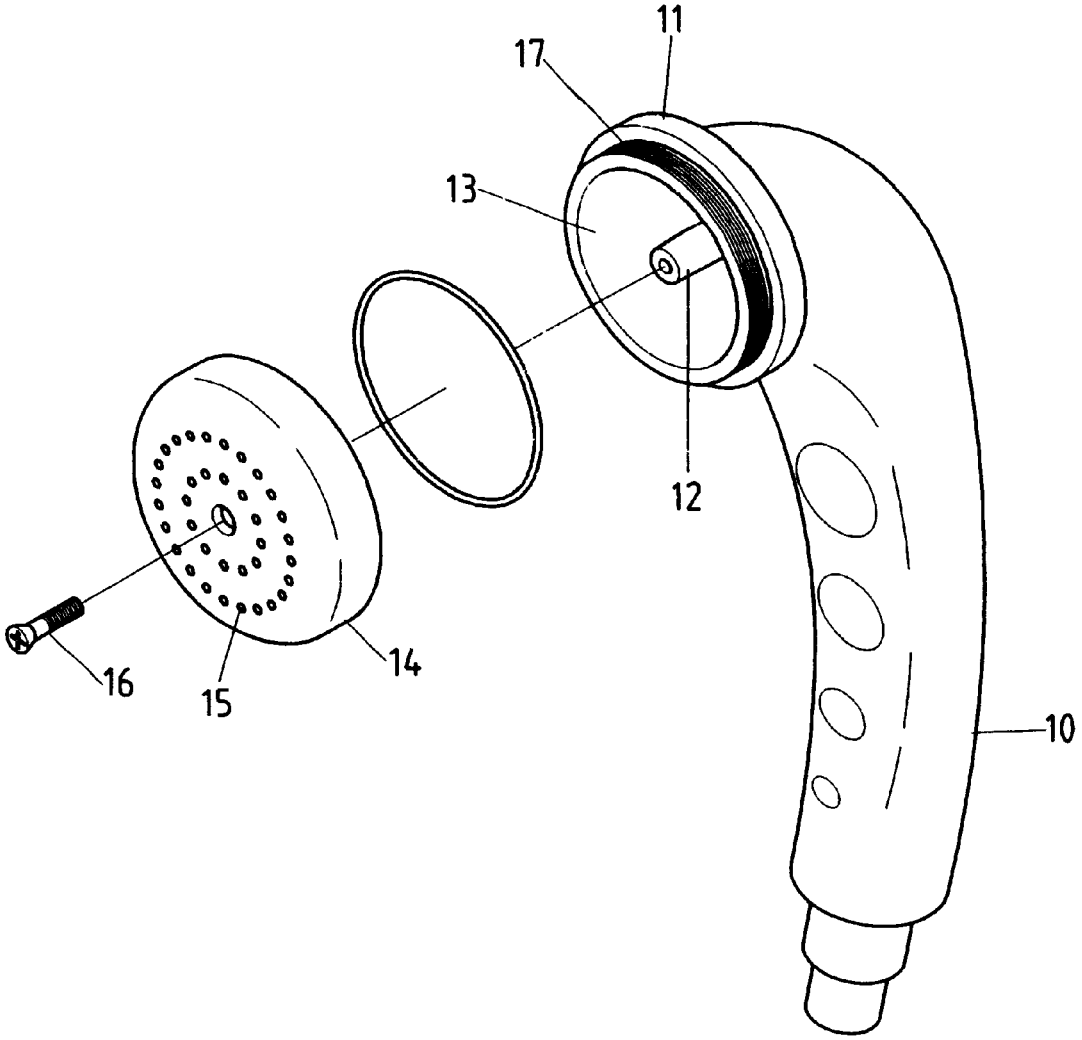
FIG.1 PRIOR ART
FIG. 1 shows an exploded view of a prior art cleaning device of a toilet bowel.
Figure 2:
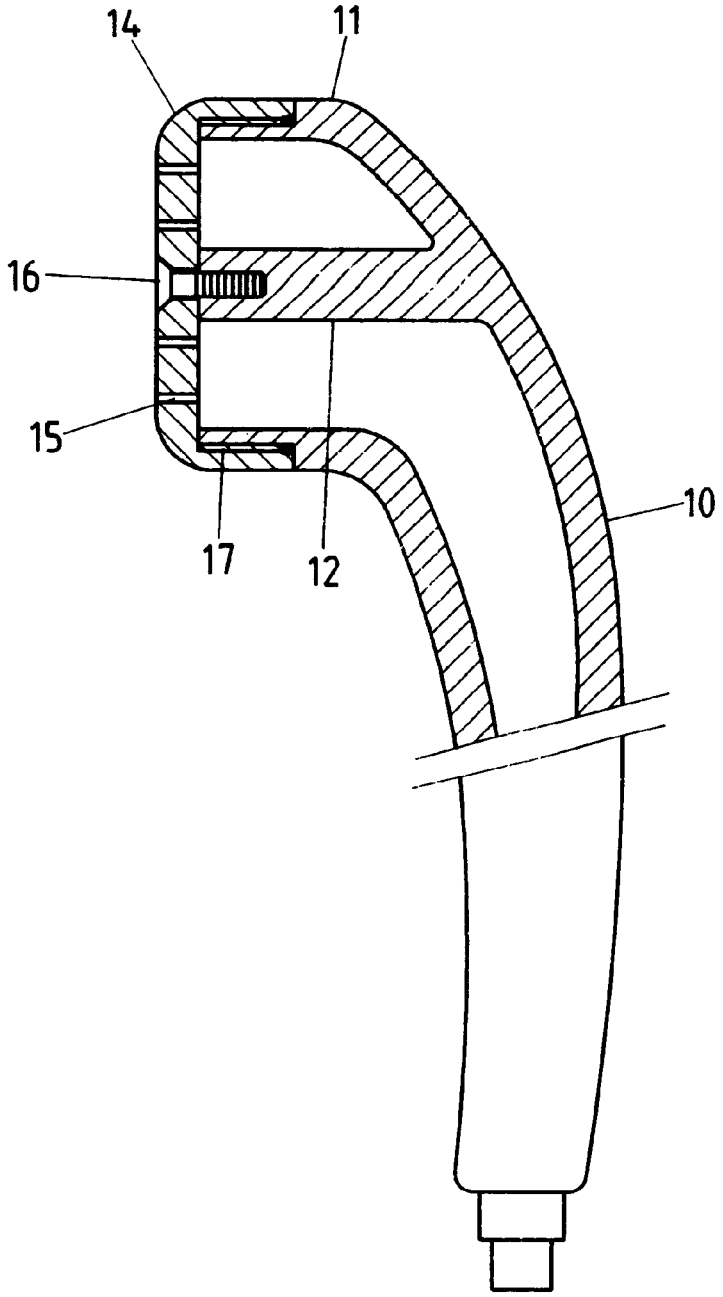
FIG.2 PRIOR ART
FIG. 2 shows a sectional view of the prior art cleaning device of a toilet bowel.
Figure 3:
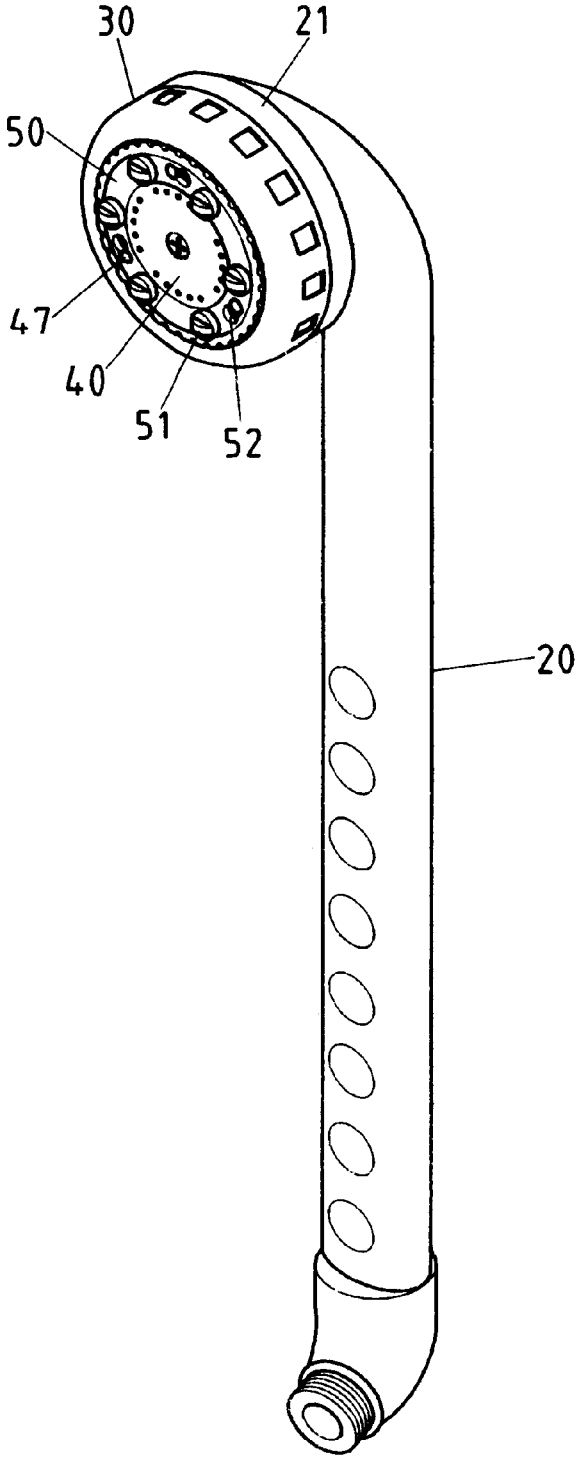
FIG. 3 shows a perspective view of the preferred embodiment of the present invention.
Figure 4:
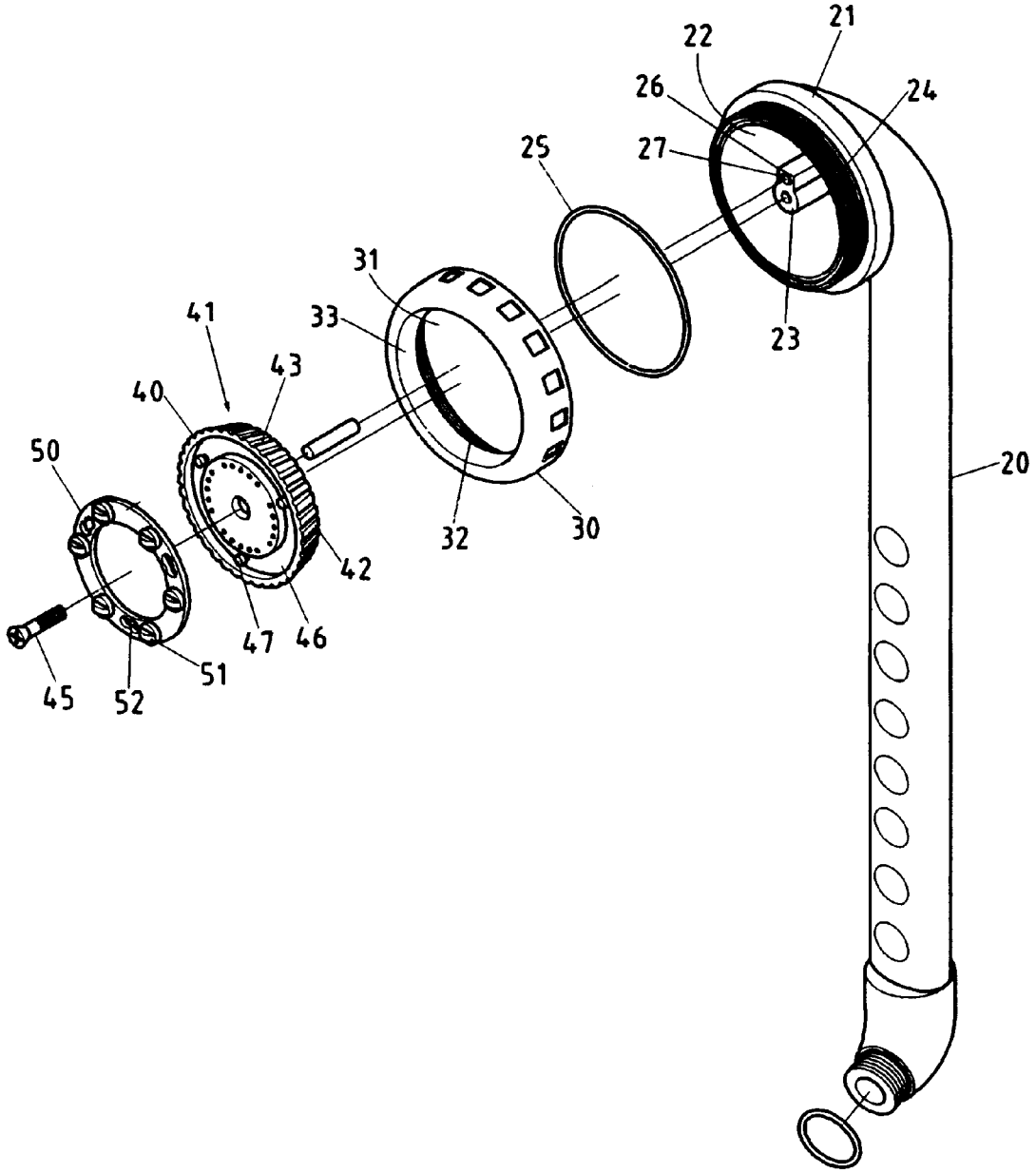
FIG. 4 shows an exploded view of the preferred embodiment of the present invention.
Figure 5:
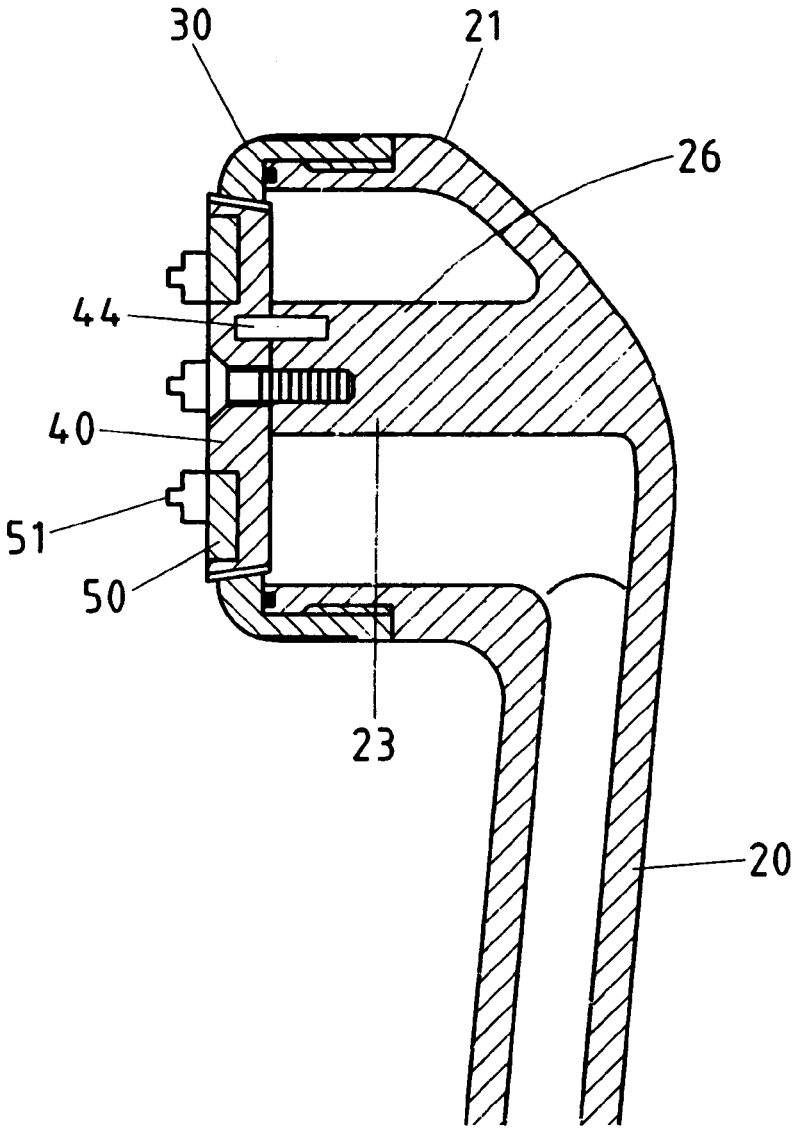
FIG. 5 shows a sectional view of the preferred embodiment of the present invention.
Figure 6:
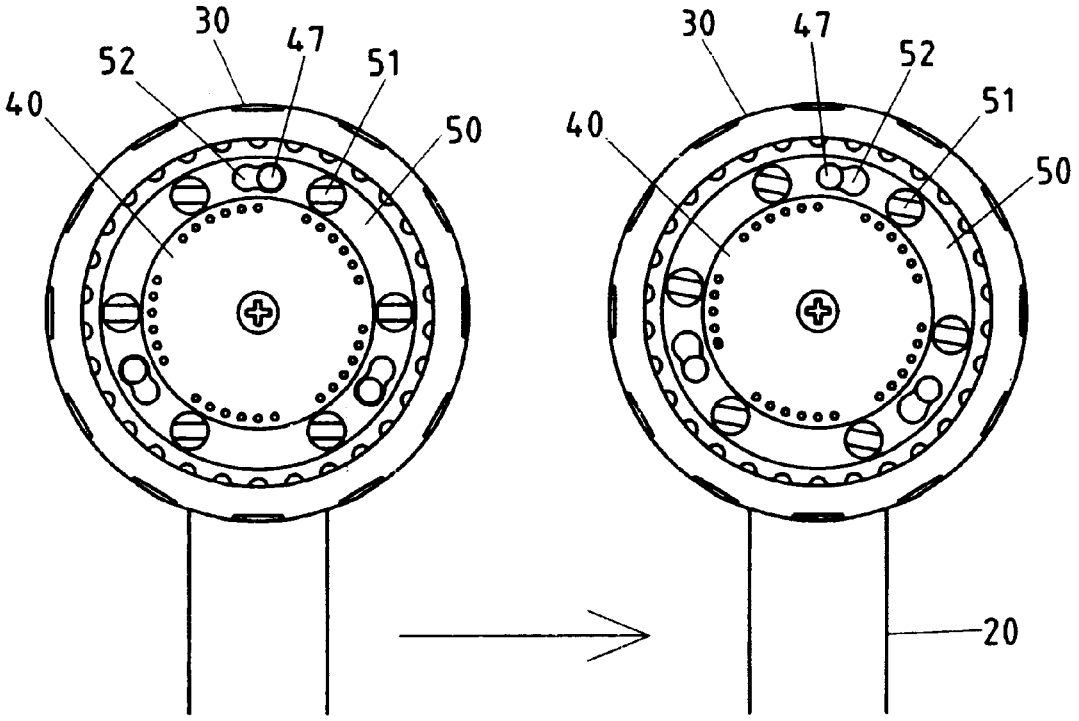
FIG. 6 shows a schematic plan view of a ring body of the preferred embodiment of the present invention.
Figure 7:
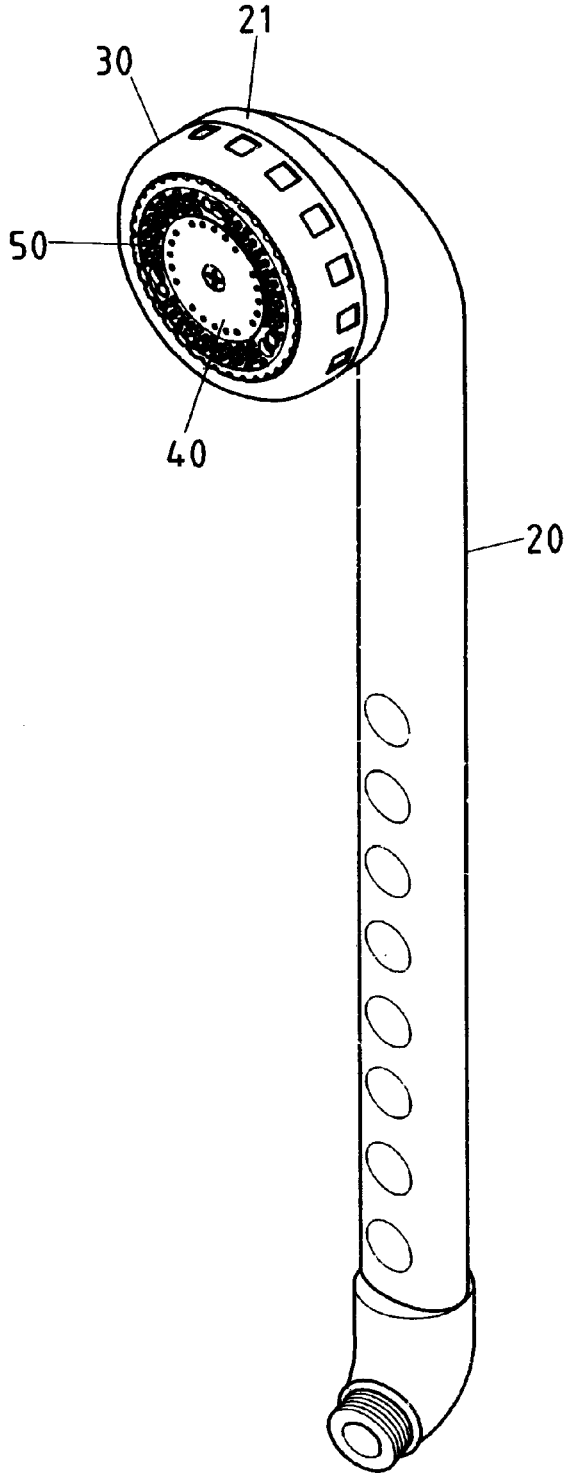
FIG. 7 shows another perspective view of the preferred embodiment of the present invention.
Figure 8:
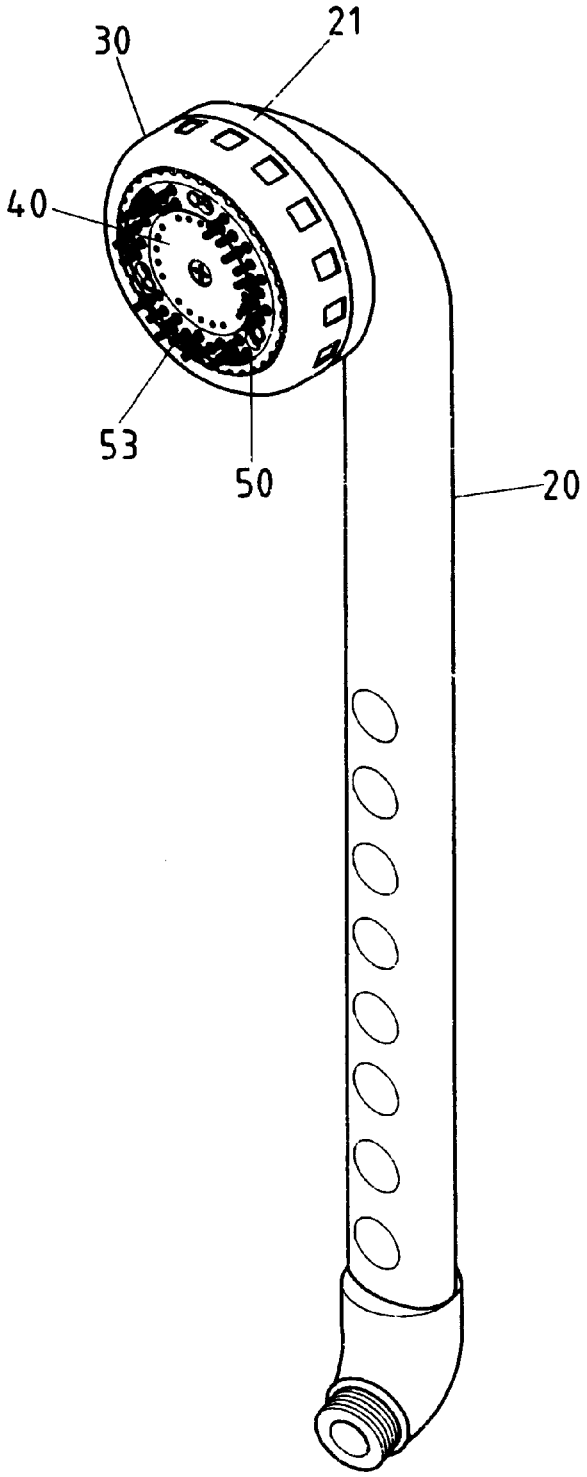
FIG. 8 shows still another perspective view of the preferred embodiment of the present invention.

As illustrated in FIGS. 3, 4, and 5, an improved cleaning device of a toilet bowel of the present invention comprises a handle tube 20, a retainer 30, a perforated plate 40, and a ring body 50.

The handle tube 20 is hollow inside and has a head seat 21 at one end thereof. The head seat 21 is formed with a receiving area 22 at one side connecting with the handle tube 20 and further protruded with a pillar 23 at the center. The outside of said head seat 21 is formed with an external thread 24 and encircled by with a gasket ring 25 at one end edge. The upper side of pillar 23 is formed with a socket 26, which is provided with a through hole 27 at one end thereof.

The retainer 30 is provided with a receiving hole 31 in the center and further formed with an internal thread 32 at the inner wall connecting with the external thread 24 of head seat 21. The inner wall of receiving hole 31 is formed with a ring 33.

The outer wall of perforated plate 40 is formed with a tapered outer surface 41 cooperating with the inner diameter of receiving hole 31 of retainer 30. The circumference of the tapered outer surface 41 is provided with a convex rib 42 and a concave trough 43. In addition, the rear end of the perforated plate 40 is provided with a rod 44 opposite to the end of socket 26 of head seat 21. The rod 44 inserts into the through hole 27 of socket 26, and a bolt 45 passes through the center surface of perforated plate 40 and further inserts into the pillar 23 of head seat 21. The perforated plate 40 uses the tapered outer surface 41 to align with the ring 33 of retainer 30. In addition, the surface of the perforated plate 40 is formed with a circular trough 46, which is provided with a plurality of pins 47 inside.

The surface of ring body 50 is formed with a plurality of protuberances 51 and further formed with a plurality of slots 52 in order to fix a plurality of pins 47 of circular trough 46. The ring body 50 can be put into the circular trough 46 of the perforated plate 40.

It is a feature of the present invention wherein one end of the slots 52 of ring body 50 is larger than the outer diameter of pin 47, and the other end is smaller than the outer diameter of pin 47. The plurality of pins 47 passes through the big end of pin 52 and is mounted on the small end of slot 52 by turning said ring body 50 to a side.

It is another feature of the present invention wherein the plurality of protuberances 51 of the surface ring body 50 can be changed to any modeling as desired.

It is still another feature of the present invention wherein the surface of ring body 50 can be painted by a brush 53.

The present invention has advantages which are described hereinafter.

As illustrated in FIGS. 3, 5, 6, and 7, the retainer 30 and perforated plate 40 are not easily loosened from the their position with effective tightness between the tapered outer surface 41 and the ring 33 of retainer 30. Furthermore the connection of rod 44 to the socket 26 is not centrally fastened; therefore, the combination of the retainer 30 and perforated plate 40 is stable and fixed. Besides, the outer wall of the tapered outer surface for fastening 41 is available with various types of ring bodies 50. Using the a plurality of protuberances 51 or brush 53 can scratch one's shoulder or rub the body.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claims.

What is claimed is:

1. A toilet bowl cleaning device comprising:

a handle tube having a connector at one end adapted for connection to a water source, said handle tube having a head seat at an opposite end thereof, said head seat having a receiving area interior thereof communicating with an interior of said handle tube, said receiving area having a pillar formed centrally thereof, said head seat having an externally threaded surface, said pillar having a socket formed on a top side thereof, said socket having a hole formed at one end thereof;

a gasket affixed around said head seat;

a retainer having a receiving hole formed centrally thereof, said retainer having an internally threaded surface engageable with said externally threaded surface of said head seat, said receiving hole defining a ring on a wall thereof;

a perforated plate having a tapered outer surface, said tapered outer surface cooperatively positioned within said receiving hole of said retainer, said perforated plate having a rod at an rear end thereof, said rod received in said hole of said socket, said tapered outer surface having alternating ribs and troughs formed thereon, said perforated plate having a bolt passing through a center thereof, said bolt engaged with said pillar of said head seat, said perforated plate having a circular trough formed therein, said circular trough having a plurality of pins extending outwardly therefrom; and a ring body having a plurality of protuberances formed on a surface thereof, said ring body having a plurality of slots corresponding in location to and affixed over respective pins of said plurality of pins, said ring body received in said circular trough of said perforated plate.

2. The device of claim 1, each of said plurality of slots having one end with a width greater than a diameter of a respective pin of said plurality of pins, each of said plurality of slots having an opposite end with a width less that said diameter of the respective pin.

3. The device of claim 1, said ring body having a brush affixed thereto.

* * * * *